United States Patent [19]

Carrotte

[11] Patent Number: 4,993,241

[45] Date of Patent: Feb. 19, 1991

[54] METHOD OF KNITTING

[76] Inventor: Frederick H. Carrotte, 9 Barry Drive, Kirby Muxloe, Leicestershire, United Kingdom

[21] Appl. No.: 609,623

[22] Filed: May 14, 1984

Related U.S. Application Data

[63] Continuation of Ser. No. 384,217, Jun. 2, 1982, abandoned, which is a continuation of Ser. No. 81,540, Oct. 3, 1979, abandoned.

[30] Foreign Application Priority Data

Oct. 3, 1978 [GB] United Kingdom ..... 7839183
Mar. 28, 1979 [GB] United Kingdom ..... 7910889

[51] Int. Cl.[5] ..... D04B 15/48; D04B 15/52
[52] U.S. Cl. ..... 66/132 T; 242/47.01
[58] Field of Search ..... 66/132 R, 132 T, 138, 66/127; 242/47.01

[56] References Cited

U.S. PATENT DOCUMENTS 2,182,295 12/1939 Lebocey ..... 66/132 R
2,199,263 4/1940 Lawson ..... 66/132 R
3,396,558 8/1968 Taylor et al. ..... 66/132 R
3,418,831 12/1968 Nance ..... 66/132 T
3,461,692 8/1969 Raisin ..... 66/132 R
3,490,710 1/1970 Mühlhäusler ..... 66/132 R X
3,911,700 10/1975 Tschomperlin ..... 66/127
4,147,311 4/1979 Jordan ..... 242/47.01

FOREIGN PATENT DOCUMENTS 1269284 5/1968 Fed. Rep. of Germany .... 66/132 T
911146 11/1962 United Kingdom ..... 66/132 R
948254 1/1964 United Kingdom ..... 66/132 R
1094854 12/1967 United Kingdom ..... 66/132 T

*Primary Examiner*—W. Reynolds
*Attorney, Agent, or Firm*—Spensley Horn Jubas & Lubitz

[57] ABSTRACT

The present invention relates to the knitting an item of fabric on a knitting machine requiring interrupted or intermittent yarn feed. In the process of the present invention, the yarn is positively fed at least during a part of the knitting process. The positive feed is removed prior to a change in the yarn feed. Yarn feed ceases or knitting continues without interruption through the change after the positive feed is terminated.

10 Claims, 4 Drawing Sheets

METHOD OF KNITTING

This application is a continuation of application Ser. No. 384,217, filed June 2, 1982, now abandoned. Ser. No. 384,217 was a continuation of Ser. No. 081,540, filed Oct. 3, 1979, which is also now abandoned.

The present invention relates to knitting and particularly to the application of positive feed in the knitting of fabrics where intermittent or interrupted yarn feeding takes place.

The concept of positive feed was first introduced about twenty years ago and has been used during that time extensively on continuous fabric machines with considerable success. In the absence of positive feed, yarn was drawn from a yarn package by a needle of a knitting machine, measured for length by the needle and finally formed into a loop by the needle. This resulted in considerable variation in the yarn tension and in the course lengths with consequential variation in the quality of the fabric produced. The application of positive feed to the knitting process ensured that yarn was delivered to the needle in the right length and at the right tension leaving the needle only to form the knitted loop. Thus by assuring that a uniform length of yarn always enters the knitting zone at each feed, positive feed has made possible the consistent production of circular cloth incorporating stitches of unvarying configuration and size in spite of differences in stitch cam settings and yarn packages of uneven density and embodying irregularities in put-up.

However, attempts to apply positive feed to other methods of cloth and garment production and to half hose, full fashioned, flat and striping machines have hitherto been unsuccessful. For example, it is known to use a circular knitting machine to knit hosiery such as socks but because of the difficulty in keeping the tension of yarn fed to the machine constant and since yarn input can vary from course to course, even when a machine is set up by a skilled knitting mechanic consecutive socks made on the same machine may tend to vary in size. The problem becomes acute where banks of machines are used to produce nominally identical sizes of socks. In practice this has meant that nominally identical socks produced on one or on different machines have had a length of leg and/or foot portion differing by an inch or more. Positive feed has been used in an attempt to overcome this problem but changes in course length during knitting of the sock, and more especially reciprocal knitting during transition, for example between leg and heel portions, necessitate changes in the positive feed for the transition from one to the other.

Hitherto attempts to effect the change in positive feed have, in some instances, relied on a change in yarn tension in order to initiate a mechanical or electromechanical movement to take the yarn into and out of positive feed, thus synchronising the change in positive feed with the change in the running yarn state. For example, in the knitting of a sock the movement from positive feed in the leg to no positive feed in the heel would exactly coincide with the change in machine and yarn state at the heel and leg transition point. However, this synchronous action is insensitive to the state of the running yarn and taking place as it does when the attendant operating variables are in a state of flux frequently causes breakage of the yarn.

Mechanisms have also been designed which, whilst externally controlled and timed (as opposed to being controlled by yarn tension), also synchronise the change in the application of positive feed with the change in the running yarn state and thus cause through their mechanical action undue strain to be applied to the said yarn causing breakage.

One such embodiment is a previously proposed positive feed device comprised of a rotatably driven wheel and a freely rotatable wheel, the yarn being fed around part of the circumference of the latter. In the absence of positive feed the yarn drives the freely rotating wheel as best it can, there being a certain amount of slip due to the inertia of the wheel which increases when dirt or lint from fibrous yarns gather around its rotating parts. To engage positive feed the freely rotatable roller is brought into contact with the driven roller sandwiching the yarn between the two rollers to enable the driven roller positively to drive the yarn. However, since the freely rotatable roller has a peripheral speed less than the driven roller for reasons just described its engagement with the driven roller causes a sudden increase in velocity, a condition which reflects in the behaviour of the yarn frequently causing it to break or snap. In addition, the yarn must be kept reasonably taught as it passes around the freely rotatable wheel in order to impart drive to the wheel. Attempting to bring the wheel speed closer to that of the driven wheel by increasing the tension of the yarn around the wheel brings the yarn closer to its breaking point thereby increasing the chance of its breaking when engaged by the driven wheel. Furthermore, the changes in yarn state which occur in, for example, striping machines have made it virtually impossible to synchronise the application of positive feed to the yarn with a change in the yarn state without breaking the yarn. Such a positive feed device proves particularly insensitive to imperfections in the yarn such as knots.

The application of positive feed to, for example flat knitting machines where the yarn is traversed to and fro by a cam carriage has hitherto proved impossible particularly because positive feed devices have proved insensitive to the rapid changes in yarn tension occuring at the ends of the carriage traverse, this again resulting in frequent breakage of the yarn.

The present invention seeks to provide an improved method and apparatus for knitting garments or fabrics.

Accordingly the present invention provides a method of knitting an item of fabric on a knitting machine requiring interrupted or intermittent yarn feed wherein the yarn is positively fed at least during a part of the knitting process and said positive feed is removed immediately prior to a change in the yarn feed while said yarn feed ceases or knitting continues without interruption through said change after said positive feed is removed.

The present invention also provides apparatus for a knitting machine for carrying out the method according to the immediately preceding paragraph comprising a positive feed device for feeding yarn to the knitting machine and means operable to engage the yarn with the positive feed device and to disengage the yarn therefrom as desired during knitting, wherein disengagement of the yarn is arranged to be effected prior to a change in the yarn feed while said yarn feed ceases or knitting continues without interruption through said change after said positive feed is removed.

The invention is particularly applicable to a machine for knitting hosiery by circular and reciprocating knitting techniques.

In contrast with the prior art the present invention does not rely for its effectiveness on a change in positive feed synchronised with the change in the state of yarn feed or fabric. Hitherto it has been assumed that if positive feed is to be used in an interrupted manner than only by using it to its absolute maximum can it be of value.

In, for example, the knitting of a sock on a circular knitting machine where positive feed is required in knitting the leg and foot portions but not in knitting the heel and toe portions previous mechanisms have synchronised the movement from positive feed in the leg portion to no positive feed in the heel portion exactly with the change in machine and yarn state and for the reasons discussed above has proved unsuccessful. The present invention allows a time lag between the movement into and out of positive feed and the change in machine and yarn state. For example, if there are 300 course or rows of knitting in the leg portion 290 of these courses would be knitted in positive feed, the positive feed being removed 10 courses prior to the transition from leg portion to foot portion. The removal of positive feed over such a short knitting length does not affect the quality of the finished product but does allow the transition to occur smoothly and without any undue tension being placed on the yarn which might cause the yarn to break.

In flat knitting vee bed and purl machines where the yarn traverses to and fro the problem of yarn control at the edges or selvedges of a knitted fabric has precluded the use of the positive feed concept. However, according to the present invention the yarn is taken out of positive feed approximately one inch, for example, from the edge of the fabric and the machine left to behave in a traditional manner at the edges whilst across the main body of the fabric control of the stitching is effected through positive feeding of the yarn. Full fashioned machines can also be controlled in this manner.

The present invention can also be applied to large diameter circular knitting machines using striping mechanisms and also to circular knitting machines making open width fabric.

In a preferred embodiment of the invention the means for engaging and disengaging positive feed is a yarn guide displaceable between a first position wherein the yarn is out of positive feed and a second position wherein the yarn is in positive feed. The yarn guide is conveniently operable directly or indirectly by at least one cam follower co-operating with a cam cylinder of the knitting machine. The device for positively feeding yarn is preferably of the type comprising a belt driveable by a variable diameter constant speed pulley, the belt driving a positive feed wheel between which and the belt the yarn is held and moved to positively feed the yarn. The positive feed wheel preferably comprises a pair of co-axial circular discs parallely spaced apart by a number of rods extending axially between the discs near a peripheral margin thereof. The rods are arranged to be longer than the width of the belt so that the belt only operates on a part of the length of each rod. The constant speed pulley is preferably driven from the knitting machines drive.

Advantageously, where different course lengths of yarn are required for different portions of a knitted garment two or more yarn feeding devices may be provided in series and operated alternately to provide different yarn feed speeds for the different portions.

Although the yarn guide is described above as conveniently being operable by at least one cam follower any suitable means of operation may be chosen. For example, it may be electromagnetically actuated and controlled by suitable means such as microswitches or it may be controlled by a bowden cable, pneumatic or fluidic means, an electric motor, a stepping motor or a combination of the above.

An apparatus according to the present invention intercepts the yarn on its path from a yarn package to the knitting machine and imparts to it control in the form of substantially constant speed. The positive feed device is preferably geared to the machine and thus the relationship between knitting cylinder speed and yarn input is always the same and can be adjusted to be so from machine to machine.

Furthermore, in a common situation where there is more than one yarn feed the variability of yarn input is compounded, a situation benefiting greatly by a preferred feature of the positive feed device where all feeds needing the same amount of yarn are driven by a common belt or from a common drive source, thus ensuring conformity within one machine, and from machine to machine.

Thus, the methodology of the present invention is one which is directed towards the knitting of an item of fabric on a knitting machine of the type requiring interrupted or intermittent yarn feed. The methodology comprises feeding the yarn at a specified yarn feed rate in a path extending around a portion of the periphery of a feed wheel. The wheel is driven by frictional engagement of a flexible endless belt with the portion of the wheel's periphery, the width of the belt being less than the axial width of the wheel's periphery. In this methodology, the yarn is selectively guidable between a first axial position on the wheel wherein the yarn is axially spaced from the belt, and a second axial position wherein the yarn is nipped between the belt and the wheel and thereby positively fed. The methodology further relates to one in which the yarn is guided from the second position into the first position immediately prior to a change in the yarn feed rate, effecting the change in the yarn feed rate, and guiding the yarn from the first position into the second position immediately after the change in yarn feed rate is effected.

The present invention is further described hereinafter, by way of example, with reference to the accompanying drawings, in which.

Figure 9:
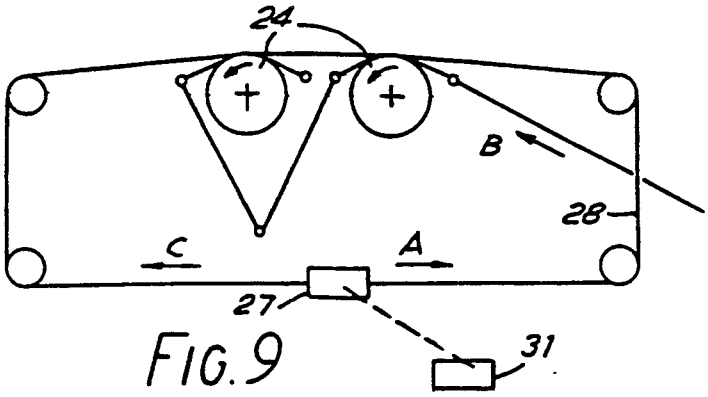
Figure 10A:
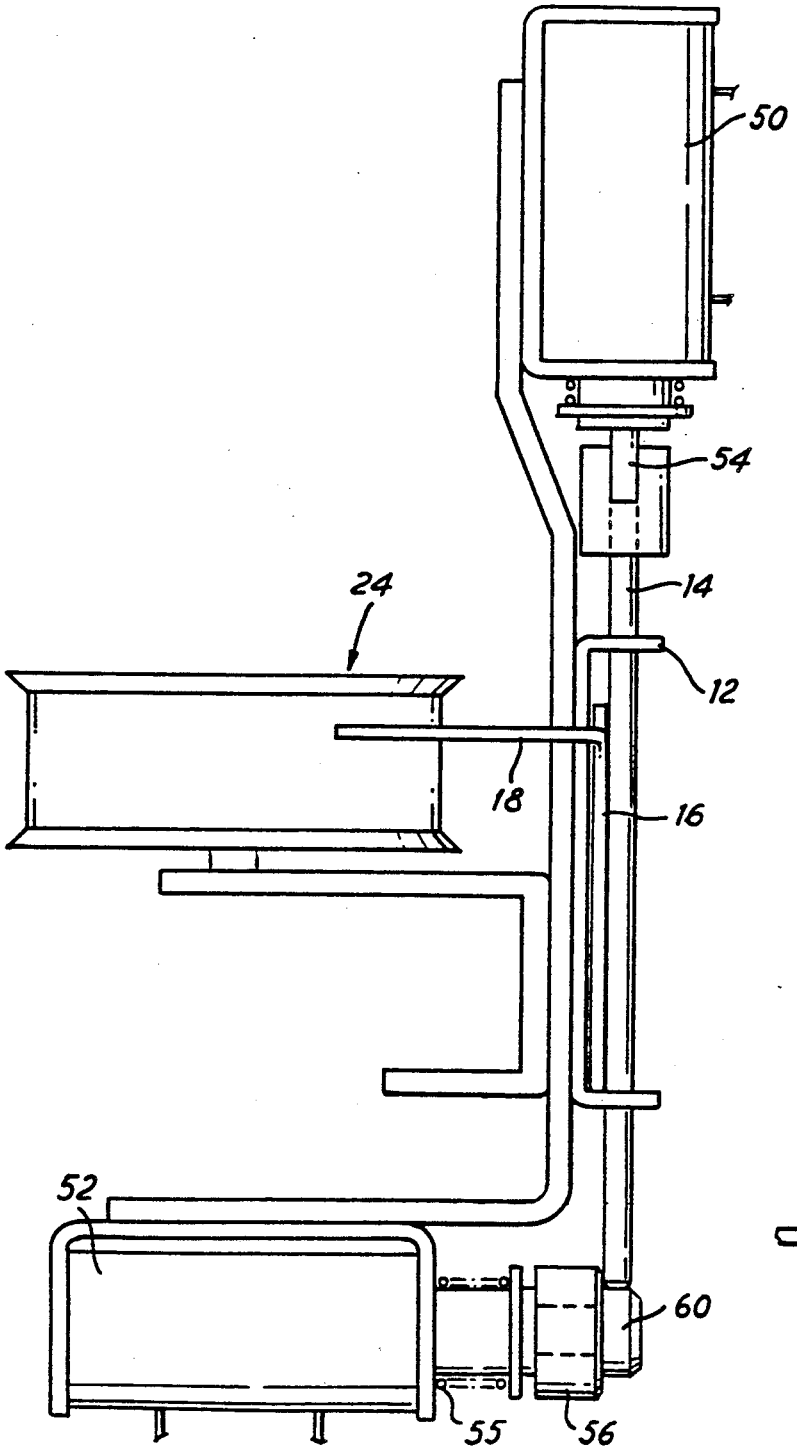
Figure 10B:
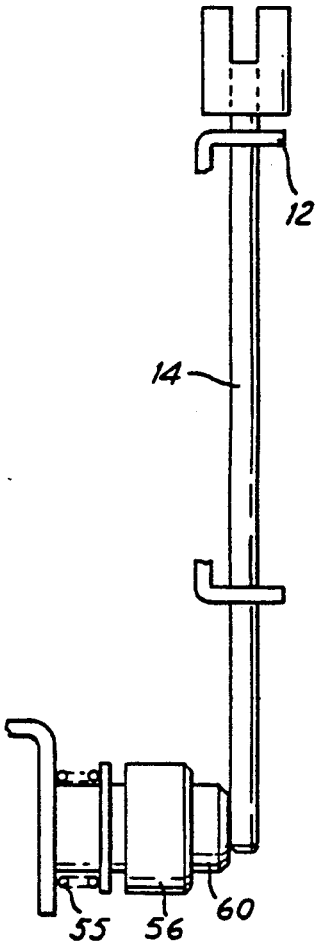
Figure 11A:
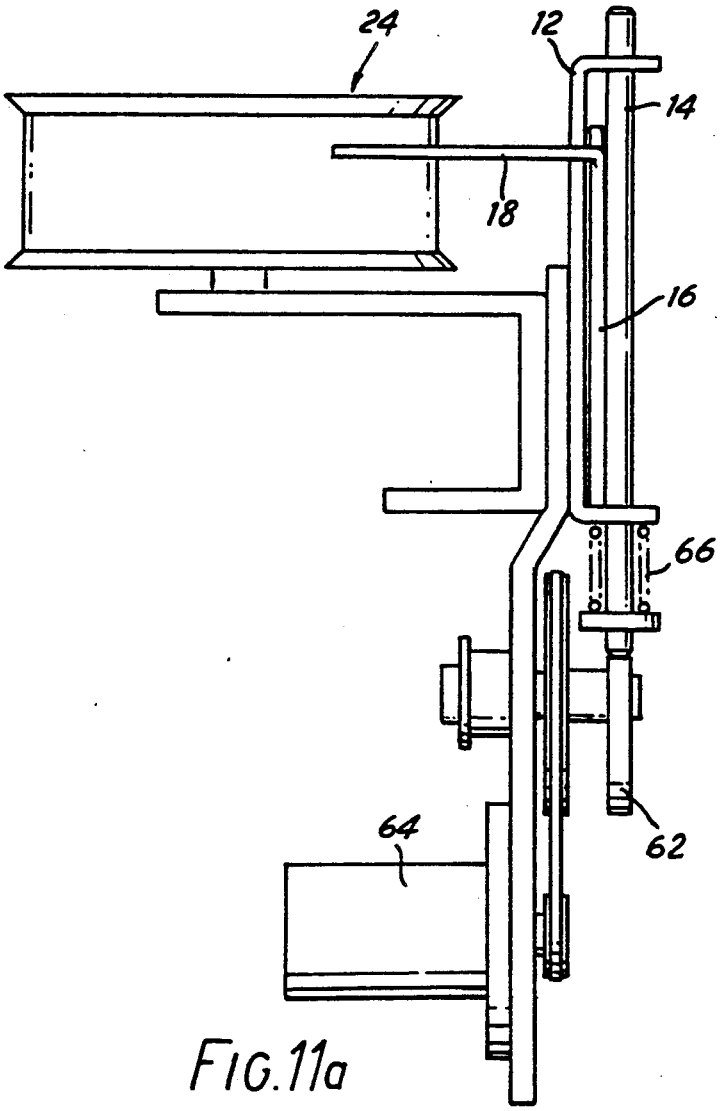
Figure 11B:
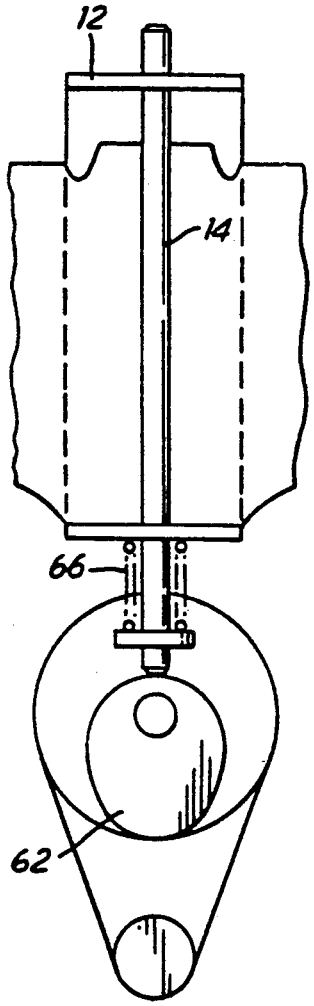

FIG. 9 diagrammatically illustrates the operation of apparatus according to the present invention during knitting of a garment;

FIG. 10*a* is a side elevation of a device for actuating a yarn guide of an apparatus according to the present invention, the yarn being in positive feed;

FIG. 10*b* is a partial view of the device of FIG. 10*a* showing the attitude of various parts with the yarn out of positive feed;

FIG. 11*a* is a side elevation of a further device for actuating a yarn guide of an apparatus according to the present invention;

FIG. 11*b* is a front elevation of the device of FIG. 11*a*; and

Figure 12:
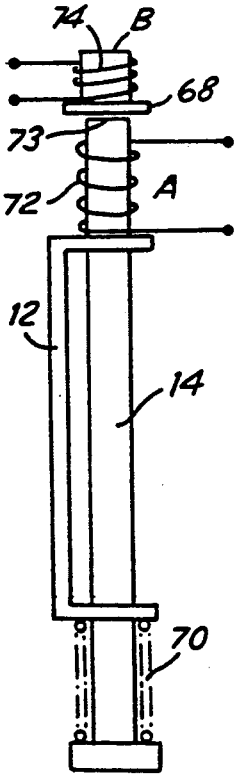

FIG. 12 is a further device for actuating a yarn guide of an apparatus according to the present invention.

Figure 1:
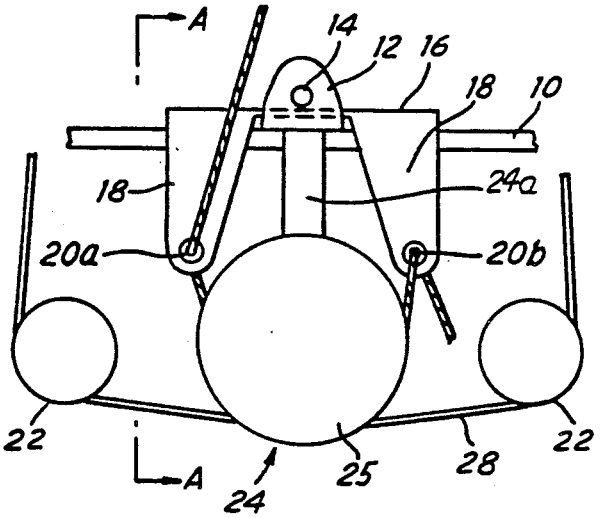
FIG. 1 is a plan view of part of one embodiment of apparatus according to the present invention.
Figure 2:
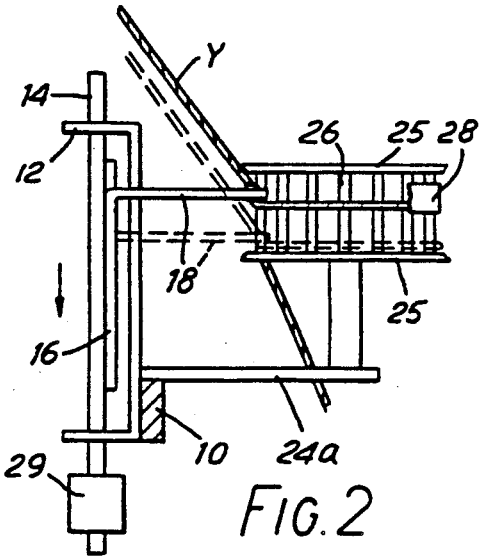
FIG. 2 is a side elevation of the apparatus shown in FIG. 1 on line 2—2 thereof showing the yarn in positive feed and also showing the yarn out of positive feed (in dotted lines)
Figure 3:
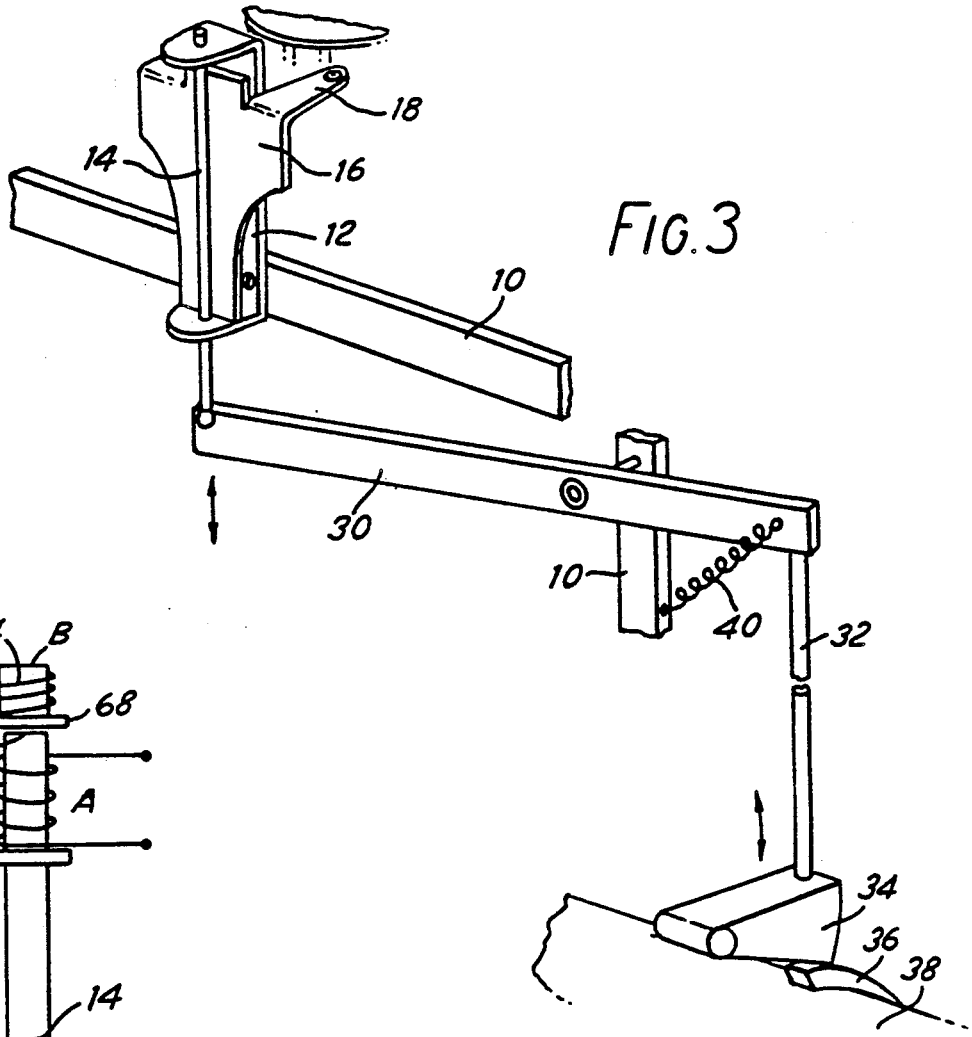
FIG. 3 is a perspective view of the apparatus shown in FIGS. 1 and 2 partially cut away.

Referring to FIGS. 1 to 3 the illustrated apparatus comprises a support 10 attached to a frame portion of a knitting machine by fixings (not shown) and which supports a guide trunnion 12. The trunnion slidably mounts a metal rod 14 which is fixedly attached to a yarn guide member 16. The latter is provided with a pair of horizontally extending arms 18 each having an eyelet 20. Movement of the rod in a vertical plane, within limits imposed by abutment of ends of the member 16 with interior surfaces of the trunnion 12, causes vertical movement of the arms 18.

The support rotatably mounts two guide pulleys 22 (see FIG. 2) on brackets (not shown) and a positive feed wheel 24 on a bracket 24*a* (shown in FIGS. 1 and 2).

The positive feed wheel 24 comprises two circular discs 25 parallely spaced apart by a number of rods 26 extending axially of the discs. The rods are disposed at spaced intervals around the periphery of the discs. The rods thus provide an interrupted cylindrical surface around part of which a drive belt 28 passes, the belt being guided by pulleys 22. The width of the drive belt is less than the distance between the discs 25 and the belt is disposed to contact an upper part of the rods 26. The drive belt 28 is driven by a constant speed, variable diameter pulley (not shown) of known type so that a variable belt speed is possible in known manner. The pulley is conventionally driven by the machine drive system.

Yarn from a creel passes through an eyelet 20*a* of one arm 18, around a part of the periphery of the positive feed wheel 24 through eyelet 20*b* in the other arm 18 and to the knitting bed of the machine.

When the member 16 is in an upper position, shown in FIG. 2, the arms 18 align the yarn passing through the eyelets therein so that the yarn passes between the rods 26 and the belt 28, and is thus positively fed to the machines.

When the member 16 is in a lower position, shown in dotted lines in FIG. 2, the arms 18 align the yarn passing through the eyelets therein so that the yarn passes around a part of the positive drive wheel not contacted by the belt 28. The yarn is not gripped by the belt and is therefore not positively fed.

Referring now to FIG. 3 the rod 14 is moved up and down as desired, to achieve intermittent positive feed of yarn, by a lever arm 30 to which it is linked and which is pivotally mounted to a part of the support 10 which in turn is moved by a rod 32 (shown partly cut away) movable vertically in a guide (not shown) under the influence of a cam follower 34 is moved by a cam 36 on the cam cylinder 38 of the knitting machine. A tension spring 40 maintains the lever arm 30 in contact with the rod 32. The yarn is thus positively fed at intervals determined by the position of cam 36 on the cylinder 38.

It is to be understood that the invention may be applied to the knitting of hosiery, and other types of garment, and in fact, in any application where an intermittent positive yarn feed is required.

The invention may be applied to the knitting of fabric where multiple yarns running at different speeds are required.

The variable diameter pulley may, instead of being driven by the knitting machine, be independently driven.

Electronic logic circuitry may be used to operate the yarn guide member 16 instead of the drive from the machine cam cylinder.

In, for example, the knitting of hosiery which may be effected on a circular knitting machine, although a sock course length of a sock leg portion may be the same as the course length of the foot portion, i.e. the amount of yarn consumed per one revolution of the machine is the same, it will be understood that the course length of the leg portion may also be different from the course length of the foot portion and the amount of yarn consumed per revolution (yarn feed rate) would therefore also differ. In this eventuality a change of speed is required for the positive feed device. This requirement arises because if the knitting machine positive feed were set to feed yarn at the desired speed for the leg portion, and were not reset for the foot portion, the knitted courses for the foot portion would be either too slack or too tight (as a result of the difference between the yarn feed rate required by the machine and the yarn feed rate of the positive feed device) with the distinct possibility of the yarn breaking.

Positive feed may also be applied to multi-feed machines with conveniently a respective positive feed device for each yarn feed. Where the yarns are fed at the same speed the devices can be driven by a common belt.

The requirement of imparting a controlled and variable speed to the positive feed device may be provided in a number of ways; by driving the variable diameter pulley either by gearing from the machine drive or by means of a d.c. motor so controlled (by means known per se) that variable yarn speed can be obtained with the garment length.

On certain types of knitted fabrics or garments there is a requirement for different course lengths in the same portion of the garment. For example, in hosiery, the welt of a sock as opposed to the leg portion may require a different course length. In this situation, the positive feed device may be speed controlled in the manner described above.

Figure 4:
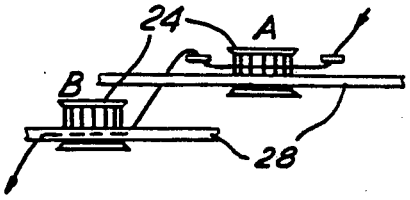
FIG. 4 is a side elevation showing two positive feed devices in series.

FIG. 4 shows one embodiment according to the present invention which enables, for example, leg and foot portions of a hosiery garment to be knitted, on for example a circular knitting machine, with different yarn course lengths. The embodiment includes two positive feed wheels 24 each with a respective yarn guide member (not shown) and its own drive belt 28. The wheels 24 are operated in the manner described above with the yarn passing firstly around one wheel and then around the next wheel. The wheels are generally operated alternately, that is the yarn is gripped by the belt passing around one wheel to drive the yarn at a first speed, the yarn passing around a part of the other drive wheel not contacted by the belt, and then when a change of yarn guide speed is required the positions are reversed with the yarn being driven around the other wheel and freely passing around the first-mentioned wheel. In this instance, both the yarn guide members may be operated by a single means such as a cam follower 34. However, where it may be desired to operate both positive drive wheels together then the respective yarn guide members will be operated independently, each by its respective cam follower.

Although only two wheels 24 are described with reference to FIG. 4 more than two may of course be employed where desired.

The drive belt 28 described above may be driven by a constant speed, variable diameter pulley which is in turn driven by a traversing cam carriage of a knitting machine, as described below.

Figure 5:
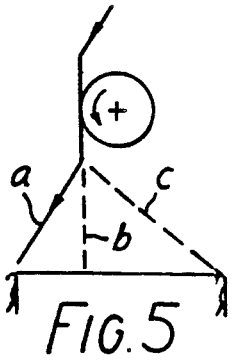
FIGS. 5 to 8 are diagrammatic illustrations of the use of a traversing cam carriage to drive the positive feed device.
Figure 6:
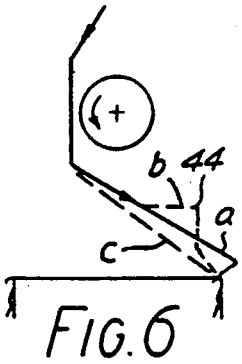
Figure 7:
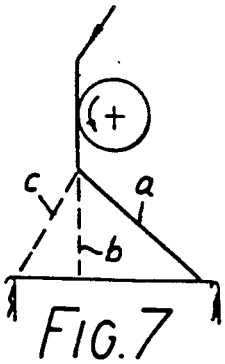
Figure 8:
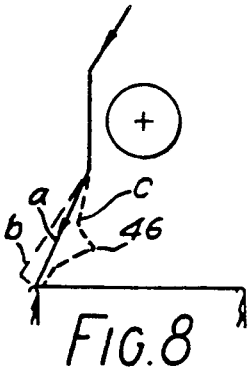

FIGS. 5 to 8 diagrammatically illustrate the operation of an apparatus according to the present invention which has a single positive feed wheel 24 driven constantly in an anti-clockwise direction (as seen in the drawings) for example by the machine drive or an independent drive. In this embodiment, as in the embodiment described below with reference to FIG. 9 the yarn is gripped and positively fed by the belt (not shown) for approximately 95% to 98% of the feed traversing path of a cam carriage (not shown). In FIG. 5 the carriage is beginning its traverse from left to right with the yarn being gripped by the belt and positively fed as shown at a. The positive feed is maintained during the traverse (the yarn path being shown in dotted lines at b and c) until as shown in FIG. 6 at a just prior to its overrun the yarn is taken out of positive feed, tension in the yarn being maintained at 44 in known manner by a beater finger as illustrated at b in FIG. 6. This overrun is the phase wherein the yarn carrier runs between one and two inches beyond the last needle of the knitting bed in order to feed the last needle with yarn. The carriage commences its traverse from right to left at c in FIG. 6, positive feed of the yarn being recommenced (FIG. 7 at a) and continuing during the carriage traverse (b and c in FIG. 7) until the carriage overruns at the end of its traverse (FIGS. 8 at a and b). The yarn is again taken out of positive feed just prior to this overrun, tension again being maintained in the yarn at 46 as the carriage commences its traverse from left to right (FIG. 8 at c). As will be appreciated, considerable advantage is therefore obtained in being able to maintain the yarn in a positive feed condition for virtually all of the cam carriage traverse.

Previous attempts to apply positive feed to knitting machines which utilise a traversing cam carriage have failed primarily because it was believed that positive feed had to be applied throughout the whole of the feed traversing path of the cam carriage and during reversal of the cam carriage at the ends of its path. Attempts to alter the positive feed rate with the changes in the yarn feed state as the cam carriage reached the ends of its path failed and often resulted in yarn breakage. Removing the positive feed just prior to the cam carriage reaching the ends of its path and then re-engaging positive feed immediately after reversal of the cam carriage solves the problem while obtaining the advantages of positive feed.

FIG. 9 diagrammatically illustrates the use of a drive where the apparatus according to the present invention includes two positive feed wheels 24 connected in series and operated alternately. As is shown in the figure the yarn passes first around one wheel in one direction and then around the second wheel in the reverse direction while the single belt 28 is formed in a continuous loop and passes across both wheels 24. The belt 28 is driven by a variable speed pulley (diagrammatically shown at 27) which in turn is driven by a cam carriage diagrammatically shown at 31. In FIG. 9 the cam carriage traverses for example to the right as shown by arrow A driving the belt in an anti-clockwise direction. In this instance the belt engages the yarn on the right hand wheel 24 while the yarn is free of the belt on the left hand wheel 24. The yarn is thus driven in the direction indicated by arrow B. When the cam carriage traverses to the left as indicated by arrow C, thus driving the belt 28 in a clockwise direction, the belt drives the yarn about the left hand wheel 24 while the yarn is free to pass around the right hand wheel 24 and is thus driven in the same direction as indicated by the arrow B. In this embodiment the yarn guide members (not shown) for the wheels 24 are actuated by a common means and their changeover may be triggered for example by microswitches which are tripped by the cam carriage at each extreme end of its traverse.

Although the yarn guide members are described above as being actuated for example by a cam follower any suitable means may be used. For example in FIG. 2 the use of a solenoid 29 is shown to raise and lower the rod 14 and thus move the yarn guide member 16. Where the movement from no positive feed to positive feed is initiated by a change in machine and yarn state or a signal from a device controlling the latter a suitable delay means is provided to allow the machine and yarn state to complete the change before the positive feed is applied.

FIGS. 10 to 12 illustrate four ways of actuating the guide member 16 to move the yarn into and out of positive feed.

In FIG. 10 the rod 14 is controlled by two solenoids 50 and 52. The solenoid 50 is vertically orientated and has an armature 54 which engages coaxially with the rod 14. The solenoid 52 is horizontally orientated and has an armature 56 biased into the position illustrated in FIG. 10*a* by resilient means such as a spring 55. The armature 56 has a reduced diameter end portion 60 on which the rod 14 rests when the yarn is in positive feed. To attain this position the solenoid 50 is pulsed on for a short duration, raising its armature and thus the rod 14. This allows the armature 56 to be moved to the right, as seen in the drawing, by the spring 55, the portion 60 supporting the rod 14 once the solenoid 50 deenergises. To move the yarn out of positive feed the solenoid 52 is pulsed on, drawing the armature 56 to the left and allowing the rod 14 to fall and move the yarn out of positive feed. The advantage of this arrangement is that it uses power only during a changeover between positive feed and no positive feed.

FIGS. 11*a* and 11*b* illustrate a yarn feed device with the movement of the rod 14 and thus the yarn guide member 16 being controlled by a cam 62 rotatably driven by a suitably geared motor 64. The rod 14 is biased downwardly into engagement with the cam 62 by gravity or by a spring 66. The cam 62 may conveniently be directly mounted on the rotor shaft of the motor 64.

Other forms of motor drive may be used, for example the rod 14 may form the rack of a rack and pinion with the pinion geared to or directly mounted on the rotor of the motor.

Finally, in FIG. 12 a permanent magnet 68 is mounted directly above the rod 14. The rod 14 is biased downwardly by a coaxial spring 70 and serves as the armature of a coil 72 wound on a former (not shown) coaxial with an upper portion of the rod 14. When the coil 72 is pulse energised the rod 14 is raised and its end 73 contacts the permanent magnet 68. In this attitude the yarn is placed in positive feed and although the coil 72 is only momentarily energised the permanent magnet 68 retains the rod 14 in its elevated position. To move the yarn out of positive feed a solenoid 74 which is attached to the permanent magnet 68 momentarily energised. This solenoid is wound in such a way as to cancel the effect of the permanent magnet 68 when energised thus releasing the rod 14 and allowing it to return to its initial position under the action of the spring 70.

Devices known as self latching solenoids may be used where a solenoid is simply used to mechanically latch a leverage system in place. Here again current is only used for the latching and unlatching operation.

In all the above instances the drive such as a motor or electromagnet may be triggered by signals from, for example microswitches tripped by a cam carriage or from logic circuitry which counts the number of knitted courses and supplies such signals at preselected counts.

I claim:

1. A method of knitting an item of fabric on a knitting machine of the type in which changes in yarn feed rate occur during the knitting process, comprising feeding said yarn in a path extending around a portion of the periphery of a feed wheel; driving said wheel by frictional engagement of a flexible endless belt with said portion of the wheel periphery, the width of said belt being less than the axial width of the said wheel periphery; and wherein said yarn is selectively guidable between a first axial position on said wheel wherein said yarn is axially spaced from said belt, and a second axial position wherein said yarn is nipped between said belt and said wheel and thereby positively fed; and when said yarn is positively fed, guiding said yarn from said second position into said first position prior to a change in the yarn feed rate, and, when said yarn is not positively fed, retaining said yarn in said first position whereby said change in yarn feed rate occurs when said yarn is out of positive feed.

2. A method as claimed in claim 1 further comprising subsequently guiding said yarn from said first position into said second position after said change in yarn feed rate has occurred.

3. A method as claimed in claim 1 or 2 of knitting an item of hosiery on a circular knitting machine wherein said yarn is positively fed during knitting of a portion of a course of said item and said yarn is guided from said second to said first position a preselected number of courses prior to the occurrence of said change in the yarn feed rate.

4. A method as claimed in claim 1 or 2 of knitting an item of fabric on a flat-bed knitting machine wherein said yarn is positively fed during knitting of at least a portion of a course of said item intermediate the ends of said course and said yarn is guided from said second to said first position prior to knitting the last end portion of said course.

5. A method as claimed in claim 1 or 2 of knitting an item of fabric on a flat-bed knitting machine characterised in that said yarn is positively fed during knitting of at least a portion of a course of said item intermediate the ends of said course and said yarn is guided from said second to said first position at the end of said course.

6. A method as claimed in claim 4 characterised in that said course last end portion is at least approximately 1 inch in length.

7. A method as claimed in claim 4 characterised in that said yarn is guided from said first position to said second position after knitting of the first end portion of the next successive course of said item.

8. A method as claimed in claim 4 characterised in that said yarn is guided from said first position to said second position at the beginning of the next successive course of said item.

9. A method of knitting an item of fabric on a knitting machine of the type in which changes in the yarn feed rate occur during the knitting process and wherein a plurality of yarns are selectively used in knitting said item and during knitting of said item a first of said yarns is taken out of knitting and a second of said yarns is selectively engaged, wherein the method comprises feeding each of said yarns in a path extending around a portion of the periphery of a respective feed wheel; driving each said wheel by frictional engagement of a flexible endless belt with said portion of the respective wheel periphery; the width of said belt being less than the axial width of the said wheel periphery and each of said yarns being selectively guidable between a first axial position on the respective wheel, axially spaced from said belt, and a second axial position, nipped between said belt and said wheel, and thereby positively fed; and prior to taking a positively fed yarn out of knitting said yarn is guided from said second position into said first position and when a yarn is selectively engaged for knitting said yarn is retained in said first position whereby said yarn is engaged when said yarn is out of positive feed.

10. A method as claimed in claim 9 characterised in that said second yarn is moved from said first position into said second position after said second yarn is engaged.

* * * * *